US005437101A

United States Patent [19]

Collins

[11] Patent Number: 5,437,101

[45] Date of Patent: Aug. 1, 1995

[54] FOLDING KNIFE

[76] Inventor: Walter W. Collins, P.O. Box 100, North, S.C. 29112

[21] Appl. No.: 223,600

[22] Filed: Apr. 6, 1994

[51] Int. Cl.[6] ..... B26B 1/04

[52] U.S. Cl. ..... 30/153; 30/154; 30/160; 30/161

[58] Field of Search ..... 30/143, 151, 153, 154, 30/155, 156, 157, 158, 161, 330, 331, 339, 160

[56] References Cited

U.S. PATENT DOCUMENTS

| | | | |
|---|---|---|---|
| 337,858 | 3/1986 | Neuhaus | 30/153 |
| 586,849 | 7/1997 | Ibelli | 7/119 |
| 770,118 | 9/1904 | Rowland | 30/153 |
| 847,206 | 3/1907 | Saunderson | 30/153 |
| 939,091 | 11/1909 | Riggs | 30/154 |
| 1,036,664 | 8/1912 | Marble | 30/161 X |
| 1,270,727 | 6/1918 | Hanstein | 30/153 |
| 1,428,296 | 9/1922 | Neft | 30/153 |
| 1,486,725 | 3/1924 | Brown | 30/154 |
| 4,227,303 | 11/1980 | Brooker | 30/154 |
| 4,426,779 | 1/1984 | Morgan | 30/138 |
| 4,730,393 | 3/1988 | Coburn | 30/153 |

FOREIGN PATENT DOCUMENTS

| | | |
|---|---|---|
| 298797 | 11/1928 | United Kingdom . |
| 1499460 | 2/1978 | United Kingdom . |

OTHER PUBLICATIONS

W. R. Case & Sons Cutlery advertisement, p. 52, Apr.-/May 1993 issue of *Blade Magazine.*

*Primary Examiner*—Richard K. Seidel
*Assistant Examiner*—Raymond D. Woods
*Attorney, Agent, or Firm*—Leatherwood Walker Todd & Mann

[57] ABSTRACT

A folding knife having a blade and a longitudinally extending liner. Pivotally connected to the liner is a blade holder receiver, or shell, which receives the liner when the blade is in a retracted position, to cover and retain the blade within the liner. The liner is also received by the shell when the blade is in the extended position, and through cooperation of the shell with the blade and the liner, the blade can be locked in its extended position. The knife may be opened and closed using one hand, and a sharpening device is provided for attachment to the liner and shell for sharpening the blade.

4 Claims, 4 Drawing Sheets

Fig. 10
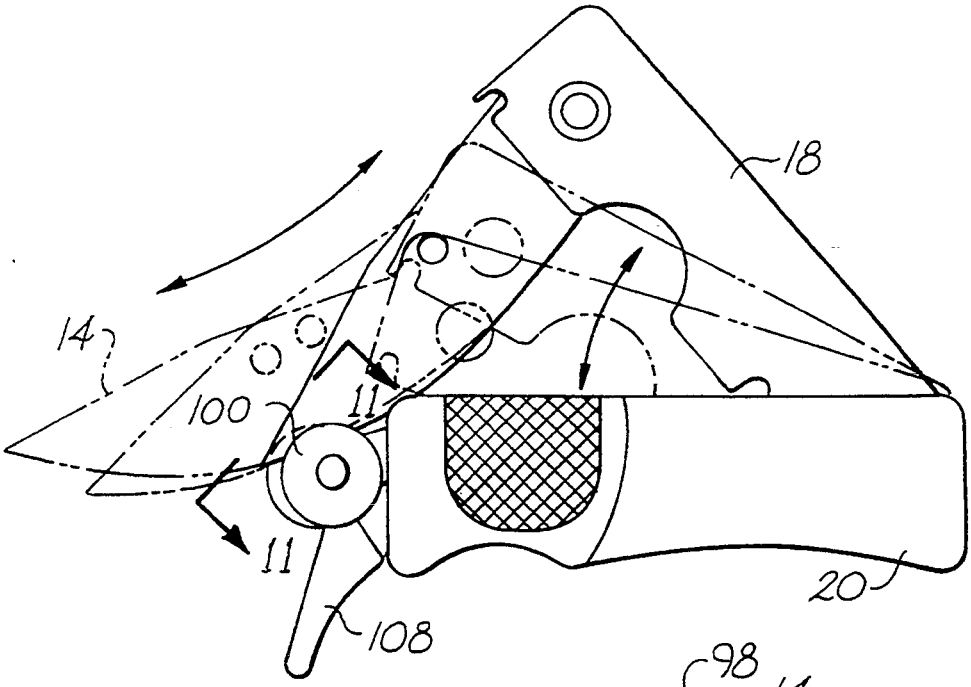
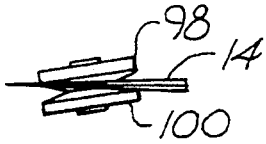
Fig. 11
Fig. 12
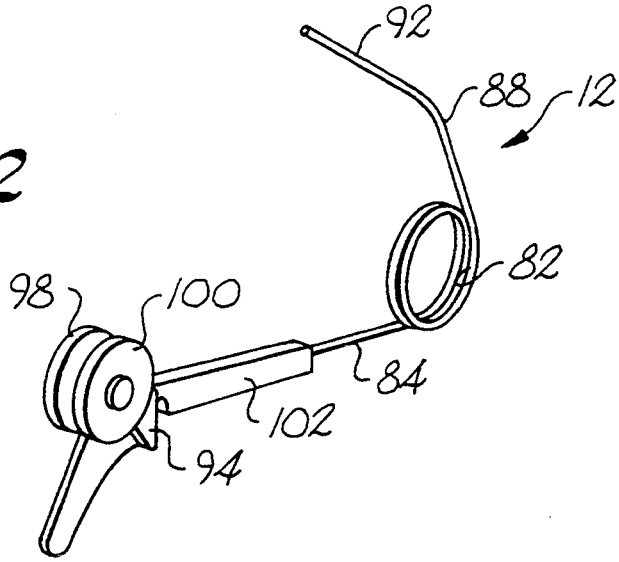

FOLDING KNIFE

BACKGROUND OF THE INVENTION

This invention relates generally to a folding knife having a blade pivotally carried within a liner and a shell pivotally attached to the liner.

Folding knives typically include an elongated handle portion which defines a blade receiving compartment. A blade is pivotally connected to the handle, and when the knife is closed, the blade is received within the blade receiving compartment. When the knife is to be used, the blade is pivoted outwardly to a retracted state from the blade receiving compartment.

A common problem with such conventional folding knives is that they require two hands to operate. One hand is required to hold the handle of the blade, and the other hand is required to grasp and extract the blade from the chamber and to pivot the blade outwardly to the retracted position. Oftentimes this requires users to take their eyes away from their work while they open the blade, causing an inconvenience. Switchblade knives may be opened with one hand, however, such knives may be outlawed in numerous jurisdictions.

Another problem with conventional folding knives is that when the blade is in its retracted state within the blade receiving chamber, the chamber is not covered, and dirt and debris may enter the chamber and foul the pivoting mechanism of the blade. Prior folding knife designs have included U.S. Pat. No. 4,730,393, issued to Coburn, which discloses a knife having a rotatable scale. U.S. Pat. No. 770,118, issued to Rowland, discloses a hunting knife having a handle and guard connected by a rule-joint. U.S. Pat. No. 586,849, issued to Ibelli, discloses a knife having tool implements. U.S. Pat. No. 847,206, issued to Saunderson, discloses a pocket knife having a stirrup and separate handle sections. U.S. Pat. No. 939,091, issued to Riggs, discloses a hunting knife having a gearing system. U.S. Pat. No. 337,858, issued to Neuhaus, discloses a folding knife having inner and outer cover members. U.S. Pat. No. 1,486,725, issued to Brown, discloses a knife having a sheath pivotally attached to a handle. U.S. Pat. No. 4,227,303, issued to Brooker, discloses a knife having a pivotal blade. U.S. Pat. No. 1,270,727, issued to Hanstein, discloses a knife having a pivoting cover.

Another problem associated with knives is the continuous requirement for sharpening of the blade. Because sharpening the blade can be a time-consuming process requiring a certain amount of skill, users often fail to keep their blades sharpened. British Patent No. 1,499,460 discloses a pocket knife having sharpening disks which are located within a channel on each side of a blade. When the blade is closed, the sharpening disks are moved along the channel to contact and sharpen the blade. A spring biases the sharpening disks toward a pivotal connection between the blade and the handle. British Patent No. 298,797 discloses a knife having a sharpening device which may be moved along the blade of a knife by the user, when the blade is in a closed position. U.S. Pat. No. 4,426,779 discloses a holder for a knife which has two beveled sharpening rollers which are spring biased toward one another and which can be used to sharpen a blade.

While various folding knife designs are available, they may present limitations which interfere with a compact, easy to manufacture device.

SUMMARY OF THE INVENTION

It is the principal object of this invention to provide a folding knife which may be opened with one hand.

It is another object of the present invention to provide a knife having a cover for the blade and blade receiving compartment when the knife is in a retracted state.

It is still another object of the present invention to provide a sharpening device for a folding knife.

It is yet another object of the present invention to provide a sharpening device which can be readily attached to a folding knife for sharpening a blade.

It is still another object of the present invention to provide a folding knife which is of compact design.

These and other aspects of the present invention will become further evident upon reference to the following drawings and accompanying specification.

Generally, one preferred embodiment of the present invention includes a folding knife having a blade, a longitudinally extending blade holder, and the blade being pivotally connected to the blade holder for movement with respect to the blade holder. The blade is moveable from a retracted blade position, wherein the blade is received by the blade holder, to an extended blade position, wherein the blade is extended from the blade holder. A longitudinally extending blade holder receiver is provided, the blade holder being pivotally connected to the blade holder receiver for movement with respect to the blade holder receiver. The blade holder is moveable from a first blade holder position, wherein the blade holder is received by the blade holder receiver, and to a second position, where the blade holder is extended from the blade holder receiver.

More specifically, the folding knife may include restraining means associated with the blade holder for preventing the blade holder receiver from moving beyond a perpendicular relationship with respect to the blade holder and also detachable sharpening means.

BRIEF DESCRIPTION OF THE DRAWINGS

The foregoing, as well as other objects of the present invention, will be further apparent from the following detailed description of the preferred embodiment of the invention, when taken together with the accompanying drawings, in which:

FIG. 10 is a side elevational view of a folding knife and blade sharpening system constructed in accordance with the present invention;

FIG. 11 is a partial plan view of sharpening rolls constructed in accordance with the present invention; and FIG. 12 is a perspective view of knife sharpening components constructed in accordance with the present invention.

DESCRIPTION OF THE PREFERRED EMBODIMENT

Figure 1:
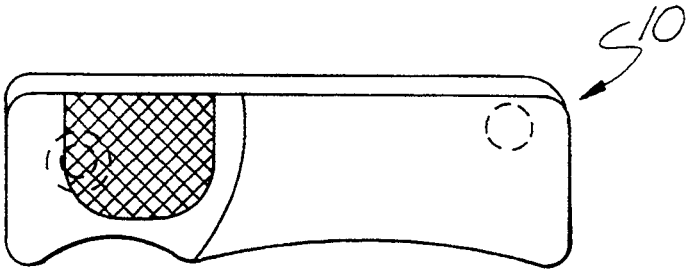
FIG. 1 is a side elevational view of a folding knife constructed in accordance with the present invention.
Figure 2:
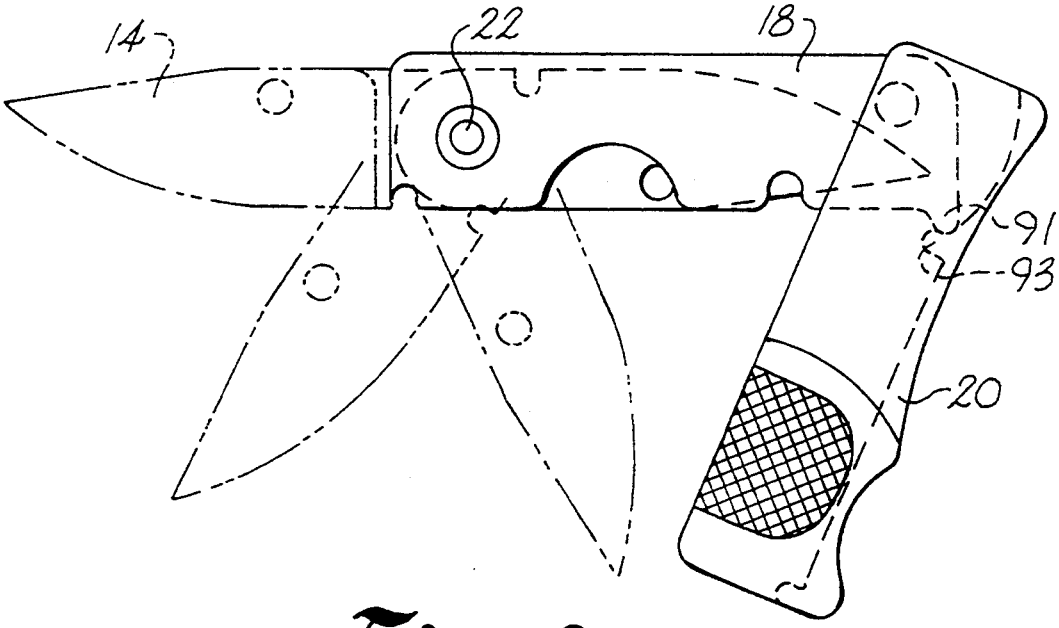
FIG. 2 is a side elevational view, with different blade positions shown in phantom, of a folding knife constructed in accordance with the present invention.
Figure 3:
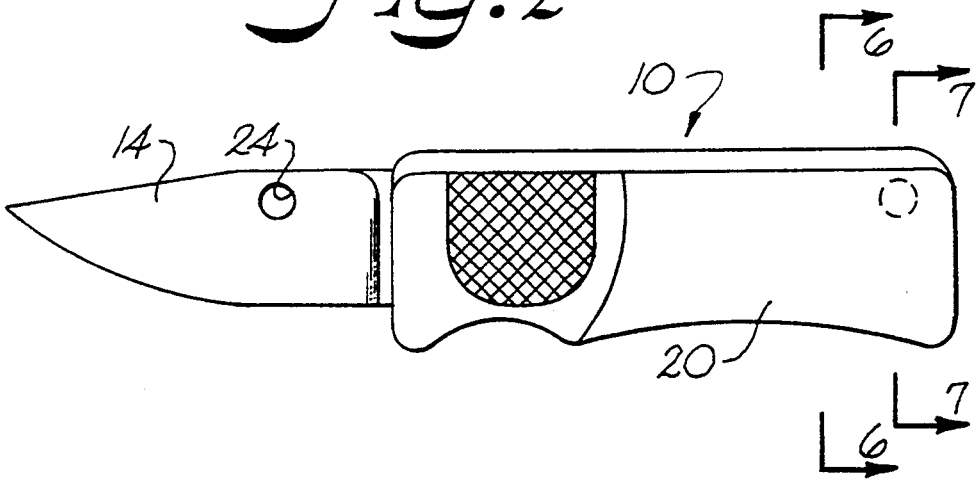
FIG. 3 is a side elevational view of a folding knife constructed in accordance with the present invention showing the blade in an extended position.

Referring to the drawings in detail, wherein like reference characters represent like elements or features throughout the various views, the folding knife and the sharpening system of the present invention are designated generally in the figures by reference characters 10 and 12, respectively.

FIGS. 1 through 4 illustrate various views of the folding knife constructed in accordance with the present invention. The folding knife includes a blade, generally 14, pivotally connected to a blade holder, or liner, generally 18. Pivotally connected to the liner 18 is a blade holder receiver, or shell, generally 20. FIGS. 1 and 5 illustrate the blade 14 in a retracted position within the liner 18. The blade 14 pivots about a pivot pin 22 which is pressed through the blade 14 and which holds the blade 14 in the liner 18. Preferably, the pivot pin 22 is fixed within the liner 18 and does not rotate with the blade 14, although the pivot pin 22 could rotate with the blade 14 if desired.

Figure 4:
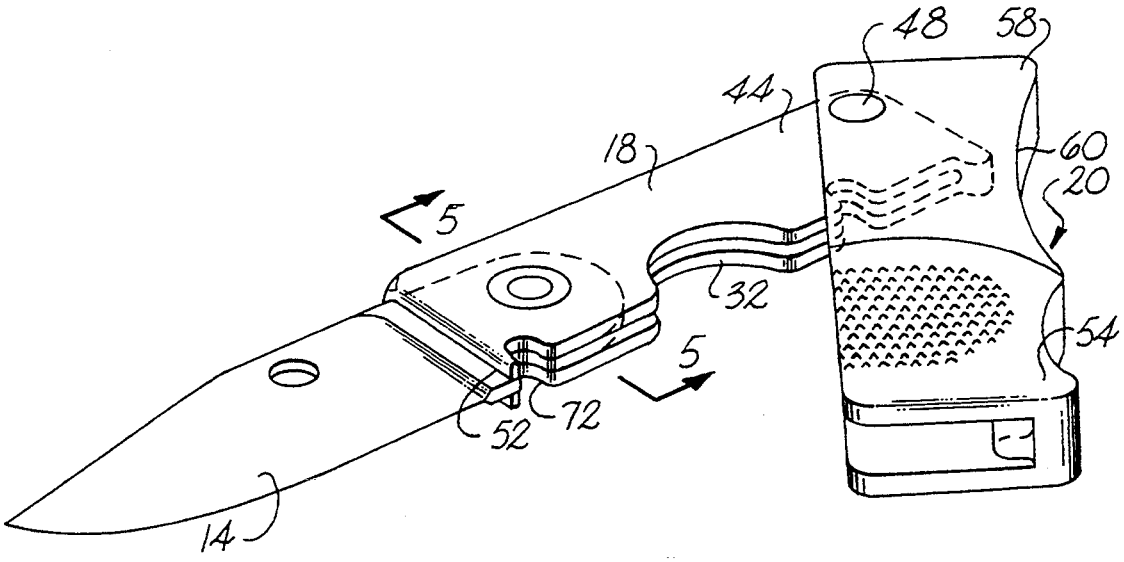
FIG. 4 is a perspective view of a folding knife constructed in accordance with the present invention.
Figure 5:
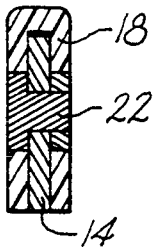
FIG. 5 is a sectional view taken along lines 5—5 of FIG. 4.
Figure 8:
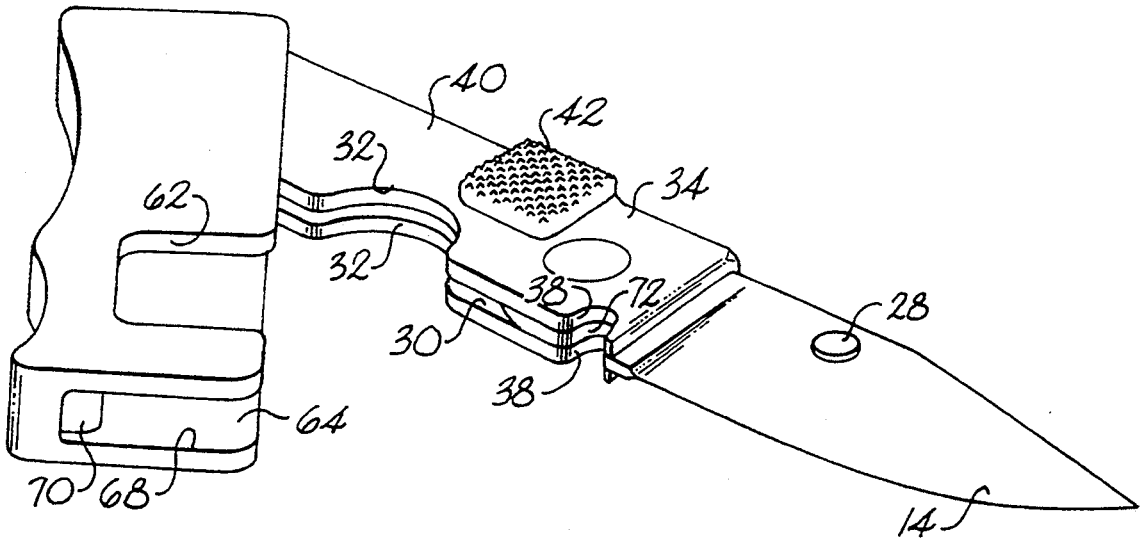
FIG. 8 is a perspective view of a folding knife constructed in accordance with the present invention.
Figure 9:
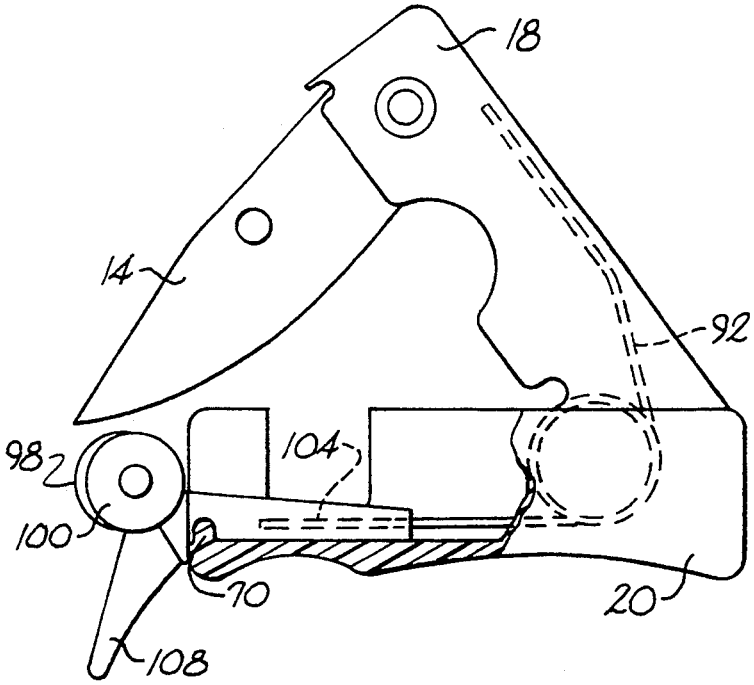
FIG. 9 is a side elevational view of a folding knife and knife sharpening system constructed in accordance with the present invention.

The blade 14 may include a hole 24 or a nail mark (not shown) which will be engaged by the user's finger to help extract the blade 14 from the liner 18, from the retracted position, to an extended position as shown in FIG. 4. Alternately, as shown in FIG. 8, a knob, or projection 28, could be provided in the blade 14 for grasping by the user's thumb and/or fingers to assist in extracting the blade 14 from the liner 18. The blade 14 is preferably constructed of cutlery steel, although other types of steel or other materials could also be used.

The liner is preferably constructed of plastic or glass-filled nylon, although any other suitable material, such as metal, wood, laminate, bone, etc., could also be used. The liner 18 includes a blade receiving cavity 30 for receiving the blade when the blade is in its retracted position. The cavity 30 is an elongated chamber, and the liner defines two access openings 32, one on each side of the liner 18, for allowing access of the user to the hole 24, nail mark, or post provided on the blade, thereby allowing for extraction of the blade from the cavity 30. Provided in each side of a forward end 34 of the liner 18 are projection receiving recesses 38, which will be discussed in more detail below.

Attached to at least one side 40 of the liner is a grip portion extending outwardly from the liner, which preferably includes a cross hatched portion 42 or other textured configuration for allowing easy grasp thereof by the user's thumb or fingers. The other end 44 of the liner includes two outwardly extending posts 48, one of which extending from each side of the liner, which are engaged in bores provided in one end 50 of the shell 20. Posts 48, if desired, may extend through the outer surfaces of shell 20, as is shown in FIG. 4.

The liner 18 is preferably of U-shaped cross-section and includes a blade opening 52 in communication with the blade receiving cavity 30 for allowing the blade to extend therethrough when the blade is in its extended position.

Figure 6:
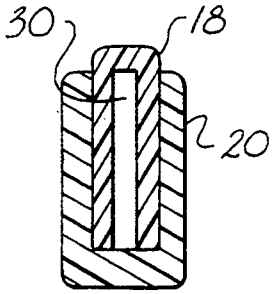
FIG. 6 is a sectional view taken along lines 6—6 of FIG. 3.
Figure 7:
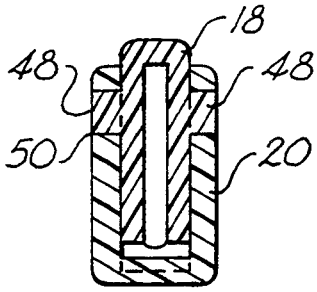
FIG. 7 is a sectional view taken along lines 7—7 of FIG. 3.

The shell 20 is also of substantially U-shaped cross-section being opened at both ends 54,58 thereof. The shell 20 includes a curved grip profile 60 which can be easily grasped by the fingers of the user when the blade is either in its extended position or is held within the liner 18 while in its retracted position. One side of the shell 20 defines a grip receptacle 62 for receipt of the grip portion 42 of the liner when the cover 20 is closed upon and receives the liner 18 in a liner receiving cavity 64 defined in the shell 20, as illustrated in FIGS. 1, 6, and 7.

The shell 20 includes an open end 54 which defines a blade passage 68 through which the blade extends when the blade is in the extended position, and the side of the shell opposite the grip receptacle is also preferably textured to aid in operation of the knife by the user's thumb and/or fingers. The shell 20 is preferably constructed of plastic or glass-filled nylon, although any other suitable material could be used.

The cavity 64 of the shell 20 includes at one end thereof a downwardly projecting projection 70 which, when the blade is extended and the shell 20 is closed over the liner 18, with the liner being received within the cavity, engages with the recesses of the liner and with a projection recess 72 defined in the end of the blade. The engagement of the projection 70 with the recesses 72 of the liner 18 and the blade securely locks the blade when it is in its extended position to allow for a rigidly fixed cutting edge to be provided.

As illustrated in FIGS. 9 through 12, sharpening device 12 is also provided with the present invention. The sharpening device 12 includes a spring member 82, which in the figures is illustrated as a torsion spring having a first leg 84 and a second leg 88. The first leg 84 extends substantially tangentially to the coil of the spring, while the second leg 88 also extends tangentially but includes a bend for receipt in the base 92 of the blade receiving cavity of the liner. The first leg 84 is received in the base of the liner 18 receiving cavity of the shell 20. Connected to the end of the first leg is a sharpening wheel holder 94 which carries for rotation thereon two sharpening wheels 98,100. The sharpening wheels 98,100 are carried co-axially with respect to one another, but are disposed at a slight angle from perpendicular with respect to the sharpening wheel holder 94.

The sharpening wheel holder 94 includes an elongated portion 102 having a bore 104 therein for receipt of the end of the first leg of the spring, and also includes a finger guard portion 108 which extends outwardly from the sharpening wheels 98,100.

In use, the sharpening device 12 is placed in the folding knife when the blade is in its extended position from the liner 18, but when the liner is pulled away from the shell 20 such that a detent recess 110 of the portion 102 engages with the detent restraint member 70 provided in the base of the shell. The detent restraint member 70 of the shell can also be engaged by the torsion spring of the sharpening system 12, to help fix the sharpening system with respect to the shell, if desired.

The first leg of the spring is placed in the cavity of the shell 20, such that recess 110 in the sharpening wheel holder engages with the projection 70 of the shell. The second leg 84 of the spring is received in the cavity of the liner. The blade is then pivoted toward the retracted position but such that the blade engages the interface between the sharpening wheels. As illustrated in FIG.

11, by holding the knife in one hand and squeezing the shell 20 and liner 18 toward one another, against the force of the torsion spring, while maintaining a finger on the top of the blade to forcibly maintain the blade 14 between the sharpening wheels, both edges of the blade can be sharpened through such repetitive motion. The sharpening wheels are carried at a slight angle with respect to the blade to ensure sufficient frictional interface between the blade and the sharpening wheels to cause the sharpening wheels to rotate slightly with respect to the blade during use.

To open and close the folding knife of the present invention with one hand, the user places the knife across his or her fingers, when the knife is in its closed configuration, i.e., with the blade being in its retracted position within the liner and the liner being received in the cavity of the shell. The user then places his or her thumb on the textured portion of the shell and the index finger on the grip of the liner. By pressing such portions and by pulling the shell and liner apart from one another, the shell will eventually move to a position engaging restraining means, wherein the detent 91 of the liner engages with the detent restraint member 93 of the shell. The restraining means, which includes detent 91 and detent restraint member 93, prevents the shell 20 form pivoting beyond a substantially perpendicular angle with respect to the liner 18. The knife is then repositioned in the user's hand, and the user places his or her thumb on the button, slot, hole, etc., of the blade and pivots the blade out of the liner. When the blade is in its fully extended state, the cover and liner are squeezed together, thereby locking the blade through engagement of the projection of the cover with the projection recesses in the blade and liner, such that the blade is ready for use. To close the knife and to move the blade from its extended position to its retracted position, the process is performed in reverse order.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art, without departing from the spirit or scope of the following claims.

I claim:

1. A folding knife, comprising an elongated blade having a cutting edge;

a longitudinally extending blade holder having a substantially U-shaped cross section, said blade holder having spaced apart walls defining a blade cavity therebetween, said blade being pivotally connected to said blade holder for movement in a plane substantially parallel to at least one of said spaced apart walls of said blade holder; said blade being moveable from a retracted blade position, wherein said blade is received within said blade cavity of said blade holder, to an extended blade position, wherein said blade is extended from said blade holder;

a longitudinally extending blade holder receiver having a substantially U-shaped cross section, said blade holder receiver having spaced apart walls defining a blade holder cavity therebetween, said blade holder being pivotally connected to said blade holder receiver for movement in a plane substantially parallel to at least one of said spaced apart walls of said blade holder receiver; said blade holder being moveable from a first blade holder position, wherein said blade holder is received within said blade holder cavity of said blade holder receiver, to a second position, wherein said blade holder is extended outwardly from said blade holder receiver; and a restraining member provided on said blade holder receiver for preventing said blade holder receiver from pivoting beyond a substantially perpendicular angle with respect to said blade holder.

2. A folding knife as defined in claim 1, further comprising said blade holder defining a blade holder opening for receiving said blade therein when said blade is in said extended position; and said blade holder receiver defining a blade passage through which said blade extends when said blade is in said extended position.

3. A folding knife as defined in claim 1, further comprising:

at least one grip portion defined on said blade holder; and said blade holder receiver defining at least one grip receptacle for receipt of said grip portion of said blade holder when said blade holder is in said first blade holder position such that said grip portion is exposed for contact by the fingers of a user.

4. A folding knife as defined in claim 1, further comprising:

an upstanding projection provided in said cavity of said blade holder receiver;

said blade defining a first projection receiving recess; and said blade holder defining a second projection receiving recess, said second projection receiving recess being adjacent to said first projection receiving recess of said blade when said blade is in said retracted position; said upstanding projection being receivable in both said first and second projection recesses when said blade is in said extended position and said blade holder receiver is in said first position, for locking said blade in said extended position with respect to both said blade holder and said blade holder receiver.

* * * * *